US006523442B2

(12) United States Patent
Lehnert et al.

(10) Patent No.: US 6,523,442 B2
(45) Date of Patent: Feb. 25, 2003

(54) TORQUE TOOL ASSEMBLY

(75) Inventors: Mark W. Lehnert, Rochester Hills, MI (US); Paul A. Podsobinski, Rochester, MI (US)

(73) Assignee: AcraDyne Inc., Troy, MI (US)

( * ) Notice: Subject to any disclaimer, the term of this patent is extended or adjusted under 35 U.S.C. 154(b) by 272 days.

(21) Appl. No.: 09/732,139

(22) Filed: Dec. 7, 2000

(65) Prior Publication Data

US 2002/0069730 A1 Jun. 13, 2002

(51) Int. Cl.[7] ..... B25B 23/151

(52) U.S. Cl. ..... 81/467; 81/469; 81/473; 173/176; 173/180

(58) Field of Search ..... 81/467, 469–470, 81/473–478, 480–483, 52.4, 52.5, 53 R; 173/176–178, 180, 12, 181, 182; 29/240; 73/862.36; 74/417, 63, 416

(56) References Cited

U.S. PATENT DOCUMENTS

| | | | | |
|---|---|---|---|---|
| 1,816,256 A | | 7/1931 | Huck | |
| 2,015,439 A | | 9/1935 | Schmidt | |
| 2,052,152 A | | 8/1936 | Webb | |
| 3,484,114 A | | 12/1969 | Rodin | |
| 3,693,483 A | | 9/1972 | Palmer et al. | |
| 4,458,565 A | * | 7/1984 | Zilly et al. | 81/469 |
| 4,485,682 A | * | 12/1984 | Stroezel et al. | 73/862.331 |
| 4,535,850 A | * | 8/1985 | Alexander | 173/176 |
| D298,908 S | * | 12/1988 | Clemens | D8/14 |
| 4,805,404 A | * | 2/1989 | Dupin | 60/409 |
| 5,076,120 A | | 12/1991 | Lin | |
| 5,195,406 A | | 3/1993 | Lindqvist | |
| 5,404,775 A | * | 4/1995 | Abe | 81/469 |
| 5,558,168 A | * | 9/1996 | Rahm | 173/178 |
| 5,662,012 A | | 9/1997 | Grabovac | |
| 5,897,454 A | * | 4/1999 | Cannaliato | 475/265 |
| 6,119,794 A | * | 9/2000 | Chen | 173/93 |
| 6,298,753 B1 | * | 10/2001 | Izumisawa | 81/57.39 |
| 6,460,629 B2 | * | 10/2002 | Bookshar et al. | 173/176 |
| 6,463,824 B1 | * | 10/2002 | Prell et al. | 74/417 |

* cited by examiner

*Primary Examiner*—Joseph J. Hail, III
*Assistant Examiner*—Anthony Ojini
(74) *Attorney, Agent, or Firm*—Harness, Dickey & Pierce, P.L.C.

(57) ABSTRACT

A torque tool assembly having an elongated unitary, cylindrical main housing and including a drive motor subassembly and a gear train subassembly coaxially supported and operatively connected in the cylindrical housing and held in operative engagement by a resilient spring structure while being mechanically, removably locked together in the main housing whereby loosening and/or mis-aligning of the operative connection between the drive motor subassembly and gear train subassembly from vibration and other loads is substantially precluded.

15 Claims, 3 Drawing Sheets

TORQUE TOOL ASSEMBLY

SUMMARY BACKGROUND OF THE INVENTION

The present invention relates to powered torque tools for applying torque to threaded fastening structures, such as threaded nuts and bolts. Powered torque tools conventionally include a drive motor drivingly connected to a gear train which in turn applies torque to a fastener through an engaging element such as a socket, tool bit, etc.

In the past a drive motor located in a cylindrical motor housing and a gear train located in a cylindrical gear housing have been coaxially connected together in operative engagement in a main housing. These forms of assembly frequently required costly threaded joints, splines, packing nuts and the like in order to connect the motor and gear housings while properly aligning and maintaining a desired driving engagement between the drive motor and gear train. One of the problems, however, is that such torque tools are constantly subject to vibrational and other loads which tend to loosen the connection between the housings and the alignment between the drive motor and gear train. This can lead to substantial wear of the engaged components, loss of efficiency and eventual failure.

The present invention is directed to a unique assembly structure and method which essentially eliminates such problems.

Here the present invention utilizes an assembly with a construction to slide a gear housing and a motor housing into a main housing and resiliently preload the gear and motor housings axially together with a spring structure such as disc springs. This can be done using a fixture to press the gear housing against the spring structure and in resilient engagement with the motor housing in the main housing. The preload is obtained and fixed when a set of openings or slots in the gear train housing align with a mating set of holes or openings in the main housing. At this point a matching pair of pins are simply installed through the aligned openings and the force for assembly is released. The pins can now retain a desired preload, such as approximately 800 pounds of tension, keeping the motor and gear housings resiliently connected together in the main housing.

In addition to keeping assembly and part costs to a minimum, this type of construction inherently provides desired concentricity and alignment between the motor and gear train and substantially eliminates chances for the housing connections to loosen, unscrew or otherwise deteriorate during operation.

At the same time the relatively simple construction facilitates disassembly for routine maintenance.

Therefore, it is an object of the present invention to provide a powered torque tool assembly with a unique construction in which drive motor and gear train housings are coaxially maintained connected in a main housing under a preselected resilient preload maintaining a desired alignment and engagement between the drive motor and gear train.

It is another object of the present invention to provide a torque tool assembly having a unique construction in which a drive motor housing and gear train housing are assembled and engaged under a preselected resilient preload by a fixed, non-rotatable connection.

It is still another object of the present invention to provide a torque tool assembly having a unique, simple construction in which a drive motor housing and gear train housing are held in engagement under a preselected resilient preload by a non-rotating locking mechanism whereby the engagement and alignment between the drive motor and gear train are maintained.

It is another object to provide a unique torque tool assembly with a unique construction for maintaining a drive motor housing and gear train housing in operative engagement under a preselected preload while inhibiting loosening and loss of preload.

Other objects, features, and advantages of the present invention will become apparent from the subsequent description and the appended claims, taken in conjunction with the accompanying drawings, in which:

Figure 1:
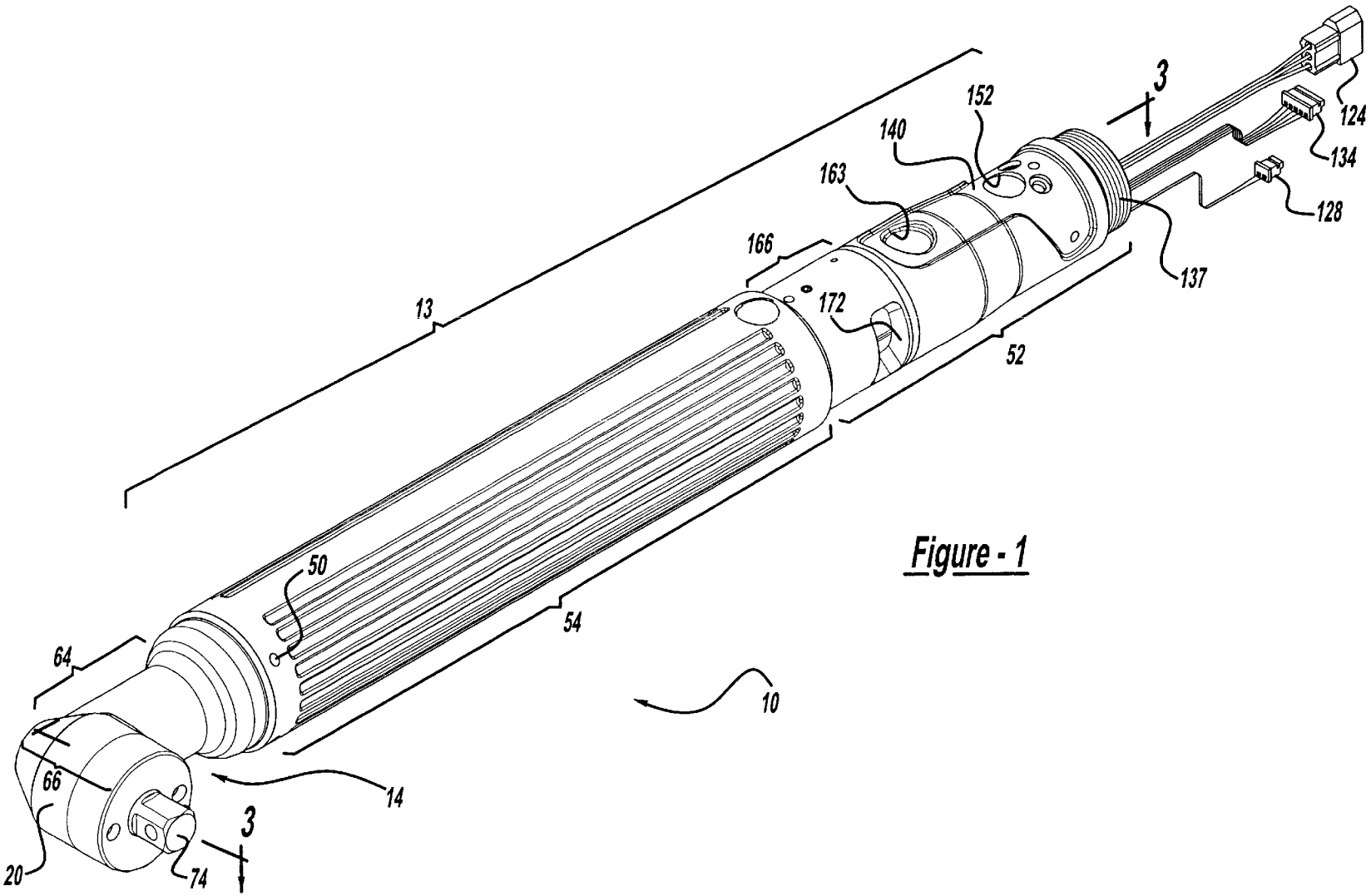
FIG. 1 is a pictorial view depicting a form of the powered torque tool assembly of the present invention with certain components omitted for purposes of clarity and simplicity.

Looking now to the drawings a powered torque tool assembly 10 is shown and includes a drive motor subassembly 12 and a gear subassembly 14 adapted to be operatively connected with a main housing 13. The drive motor subassembly 12 includes an elongated, cylindrical motor housing 16 and an electric drive motor 18 supported inside the housing 16. The gear subassembly 14 includes a right angled gear train housing 20 with a gear train 22 supported therein and adapted for right angled drive. The operational apparatus of the drive motor subassembly 12 and gear subassembly 14 can be constructed in accordance with elements well known in the art and hence shall be only generally described for purposes of brevity and simplicity. In this regard the electric drive motor 18 is located, as noted, and fixed within the motor housing 16 and hence is not shown. But first attention should be directed to the unique construction of the present invention whereby the drive motor subassembly 12 and gear subassembly 14 are operatively connected together with the main housing 13.

As can be seen from the drawings, the drive motor subassembly 12 has an annular locating ring 24 integrally formed at the outer end of the drive motor housing 16 and extending outwardly from a recessed section 26. See FIGS. 2–4. Upon initial assembly of the drive motor subassembly 12 into the main housing 13 the drive motor subassembly 12 is located with the locating ring 24 engaged with a reduced diameter, annular inner stop shoulder 30 at a preselected location inside of the main housing 13. The gear subassembly 14 has a cylindrical ring gear 40 with a connecting portion 41 which extends coaxially and circumferentially over a support portion 43 at the inner end of the gear train housing 20. The connecting portion 41 is immovably fixed to the support portion by an interference shrink type fit. At the same time the cylindrical ring gear 40 has a fixed outer ring section 48 which extends rearwardly and. axially inwardly from the connecting portion 41 and the housing support portion 43. Now a pair of disc springs 32 and 34 are located in the main housing 13 with the first disc spring 32 supported in a counterbore 36 in the outer end of the locating ring 24. The other or second disc spring 34 is located and supported in a counterbore 38 at the inner end of the fixed, outer ring gear section 48. In this way the first disc spring 32 and second disc spring 34 are supported for coaxial and radial alignment with each other. Next the gear train subassembly 14 is moved into the outer end of the main housing 13 with the disc springs 32 and 34 in alignment for resilient engagement.

Figure 3:
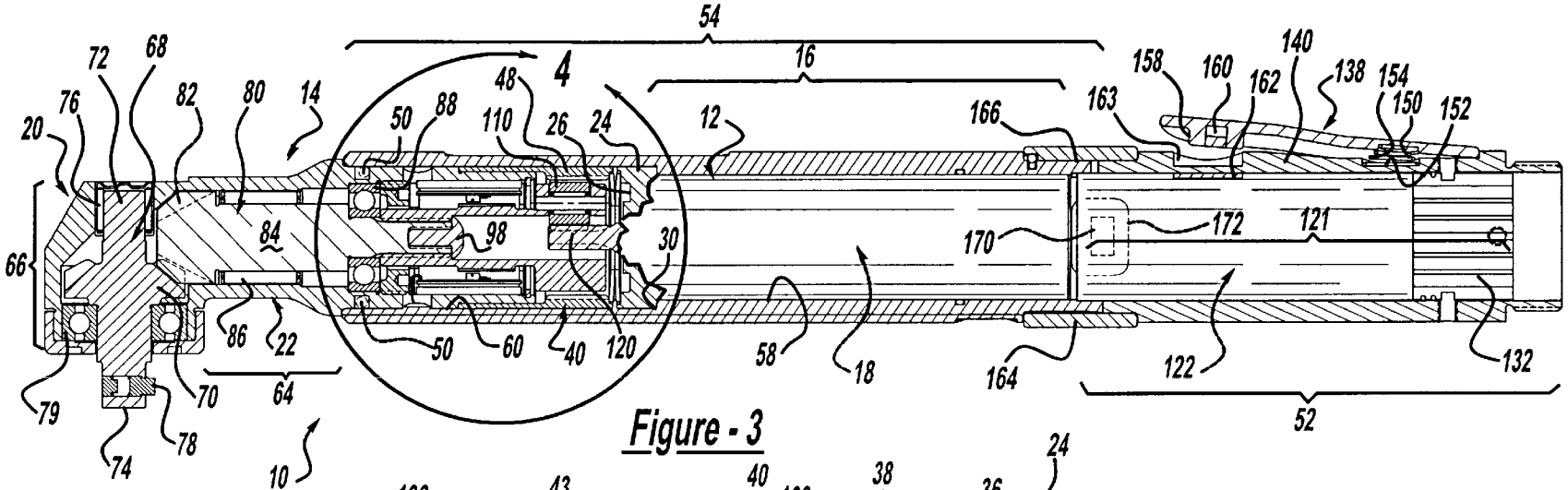
FIG. 3 is a longitudinal side elevational, sectional view of the torque tool assembly of FIG. 1 taken generally along the lines 3—3 in FIG. 1 and including the components omitted from FIG. 1.
Figure 4:
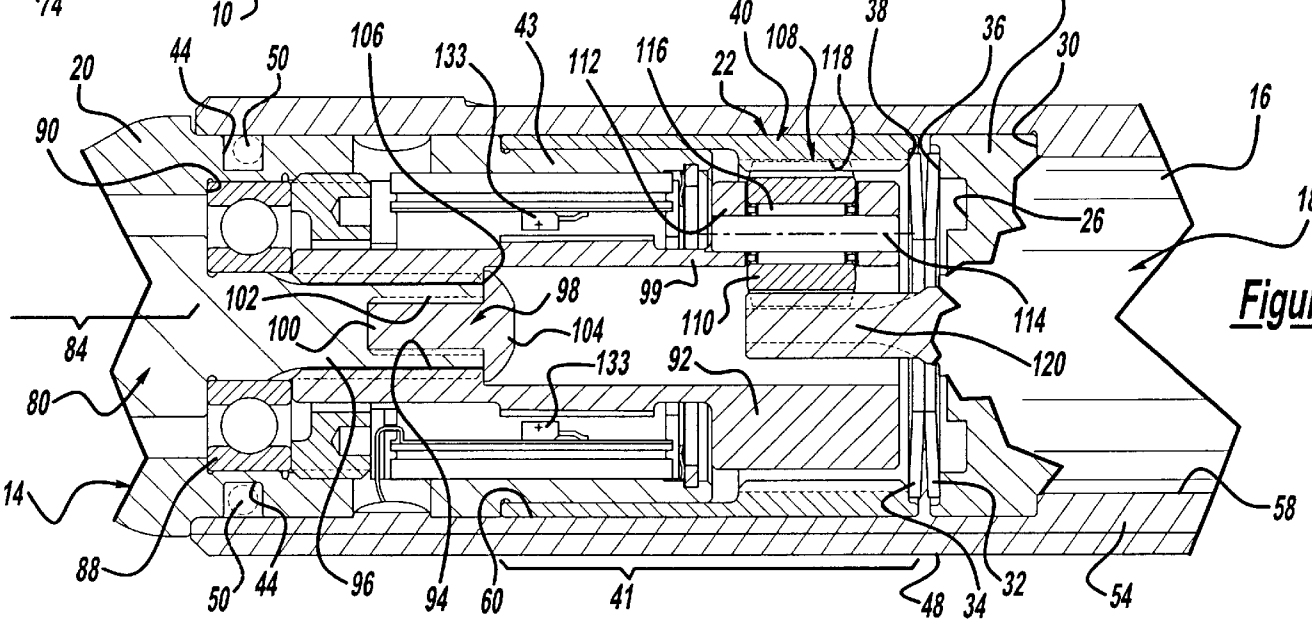
FIG. 4 is an enlarged fragmentary view of the torque tool assembly of FIGS. 1–3 taken generally in the Circle 4 in FIG. 3.

The outer end of the main housing 13 is provided with a pair of circumferentially spaced aligned holes or openings 42. At the same time the gear train housing 20 is provided with two pairs of diametrically opposite slots 44 and 46. In assembling the gear subassembly 14 with the drive motor subassembly 12, the gear subassembly 14 is moved into the main housing 13 with the ring gear 40, and thus the gear train housing 20, being moved into resilient compressive engagement with the disc springs 32 and 34 and relative to the motor housing 16 via the locating ring 24 and the main housing 13 via the stop shoulder 30. The disc springs 32 and 34 upon initial engagement with the fixed ring gear section 48 will locate the holes or openings 42 spaced axially from the slots 44, 46. The disc springs 32 and 34 are resiliently compressed as the holes or openings 42 of the main housing 13 are located in alignment with a preselected pair of the slots 44 and 46. Now a pair of pins 50 are moved through the openings 42 and into the aligned ones of the slots 44 and 46 and the gear subassembly 14 is released and is now held in assembly with the drive motor subassembly 12 and main housing 13 under a predetermined resilient, tensile force. The magnitude of the resilient, tensile force can be readily predetermined and set by the selection of the resilience of the disc springs 32 and 34, the degree of compressive engagement required and the like. As can be seen by simply selecting one or the other of the pairs of slots 44 and 46 in the drive gear housing, the circumferential, right angled orientation of the gear subassembly 14 relative to the main housing 13 and the drive motor subassembly 12 can be selectively set at four 90° positions. In the drawings of FIGS. 3 and 4, the pins 50 are shown in slots 44 and are shown in dotted lines since with the gear subassembly 14 oriented as in FIGS. 1, 3 and 4 the pins 50 will be located in slots 46.

Looking now to the drawings, the main housing 13 is of a one piece cylindrical construction and includes a motor control housing section 52 at its rearward end and a support housing section 54 at its forward end. The main housing 13 has a generally circular through bore 56 with a first bore portion 58 of a uniform diameter extending from the rearward end and connected to an enlarged diameter second bore portion 60 at the forward or outer end. The juncture of the small diameter bore portion 58 with the larger diameter second bore portion 60 defines the inner stop shoulder 30 previously discussed.

Thus the drive motor subassembly 12 is held from axial movement rearwardly at a preselected position in the main housing 13 by the engagement between the locating ring 24 and the main housing stop shoulder 30. At the same time the gear train subassembly 14 is held from forward or rearward axial movement by the fixed engagement of pins 50 in openings or slots 44 or 46. Now the drive motor subassembly 12 is resiliently held from axial forward or outward movement relative to the gear train subassembly 14 by the preselected preload of the disc springs 32 and 34. It can be seen then that the desired driving engagement and alignment between the drive motor 18 and the gear train subassembly 14 will be resiliently maintained while still facilitating assembly and disassembly for routine maintenance. With this in mind let us now look to some of the other details of the elements of the torque tool assembly 10.

Looking now to FIGS. 3 and 4, one form of the gear subassembly 14 is shown. The right angled housing 20 includes an axial housing portion 64 and a right angled housing portion 66. As noted, the connecting portion 41 is fixed to the inner end of the axial housing portion 64. The gear train subassembly 14 includes a right angled output drive member 68 rotatably supported in the right angled housing portion 66 and includes a beveled output gear 70 located midway between upper and lower support shaft portions 72 and 74. The upper support shaft portion 72 is rotatably supported by a needle bearing 76 while the lower support and output shaft portion 74 extends rotatably past the right angled housing portion 66 and has a radial detent pin 78 adapted to rotatably engage a drive member such as a socket (not shown). The beveled output gear 70 is adapted to engage the inner race of a ball bearing 79 at the outer end of the angled housing portion 66 whereby the right angled output drive member 68 is rotatably supported.

An input drive member 80 has a right angled pinion drive gear 82 adapted to drivingly engage the beveled output gear 70. A drive shaft 84 extends rearwardly from the pinion drive gear 82 and is rotatably supported in the axial housing portion 64 at its axially outer end by a needle bearing 86 and at its axially inner end by the inner race of a ball bearing 88.

At the same time the outer race of the ball bearing 88 is clamped against an inner shoulder 90 in the axial housing portion 64. A planetary support member 92 has an internally splined bore 94 which is drivingly engaged with a similarly, externally splined drive rod portion 96 at the inner end of the drive shaft 84 of the input drive member 80. The planetary support member 92 and the input drive member 80 are axially secured together by a locking bolt 98 located in an enlarged bore 99 in the planetary support member 92. The bolt 98 has a threaded shank 100 engaged in a threaded bore 102 in the drive rod portion 96 and an enlarged head 104 engaging an internal shoulder 106 in the bore 99. At the same time the planetary support member 92 is secured in engagement with the inner race of the ball bearing 88.

The axially inner end of the planetary support member 92 supports a planetary gear assembly 108 which includes three equally circumferentially spaced planetary gears 110. For purposes of simplicity only one planetary gear 110 is shown in the drawings. Each planetary gear 110 is located in a slot 112 through the inner end of the planetary support member 92 and is rotatably supported on a pin 114 by a needle bearing 116. The gear teeth of the planetary gears 110 are in mesh with the gear teeth 118 in the ring gear section 48.

The electric drive motor 18 has a drive shaft 120 with a plurality of gear teeth engaged with the gear teeth of the planetary gears 110. Thus when the electric drive motor 18 is energized the drive shaft 120 will be rotated to drive the planetary support member 92 via the engagement between the drive shaft 120 and the planetary gears 110 and between the planetary gears 110 and the fixed ring gear section 48. This in turn will rotate the input drive member 80 by way of the drive shaft 84 which in turn will rotate the output shaft portion 74 of the output drive member 68 through the driving engagement between the pinion drive gear 82 and the beveled output gear 70 of the output drive member 68. The pinion drive gear 82 and beveled output gear 70 are in a one to one and one half ratio. However, the gear ratio of the ring gear section 48 is less than one and is selected to determine the relative rotational speed of the drive member 80 and drive shaft 84. With torque tool assemblies of this type it is common to provide a reduction of around 50:1 of the speed of motor drive shaft 120 to the speed of drive member 80.

In one form of the invention the electric drive motor 18 was operated by direct current from an external source, not shown. An electric circuit assembly 121 has a control circuit board 122 which is provided with the necessary input and output circuitry to control the drive motor 18 while at the same providing signals of torque magnitude and other parameters desired to be tracked or recorded. It should be noted that the electric drive motor 18 and electric circuit assembly 121 can be of types well known in the art and thus the specific details thereof do not constitute a part of the present invention and have been omitted for purposes of brevity and simplicity. In this regard, in FIG. 2 the control circuit board 122 is depicted with numerous circuit elements which are shown mainly to illustrate a typical arrangement and as noted the details thereof do not constitute a part of the present invention and hence have not been described and thus are omitted in FIG. 3. As can be seen in FIGS. 2 and 3, the electric circuit assembly 121 is located and supported in the control housing section 52 of the main housing 13. An electrical input plug 124 from the drive motor 18 is adapted to be removably engaged with a connector plug 126 from the circuit assembly 121. At the same time an output sensor plug 128 from the drive motor 18 is adapted to be removably engaged with a sensor plug 130 from the circuit board 122. The magnitude of output torque generated at the gear subassembly 14 is sensed by transducers 133 and the torque signal is transmitted to the control circuit board 122 via torque signal lines with a plug 134 adapted to be connected to the circuit board 122 (see FIGS. 1, 2 and 4). Again the details of the torque sensing transducer and related elements do not constitute a part of the present invention and also have been omitted for purposes of brevity and simplicity.

As can be seen in FIG. 2, the electric circuit assembly 121 terminates in a circular, support plug portion 132 at the outer end of the circuit board 122 which assists in supporting the circuit assembly 121 in the main housing 13. Thus the plug portion 132 is slidably movable within the outer end of the control housing section 52 and is secured there by bolts 135 which are engaged with threaded bores 136 in the plug portion 132. The plug portion 132 has a socket accessible from its outer end to receive a removable external plug (not shown) from a source of direct current input power from a remotely located control board (not shown) with the various parameters being measured and other information such as tool identification, etc. collected by the circuit board 122 being transmitted to the remote control board for recording, display, etc. The removable external plug after being interconnected with the plug portion 132 can be threadably fixed to the main housing 13 at the externally threaded portion 137 at the end of the main housing 13. The plug portion 132 and socket and external plug with threaded connector can be of a conventional construction and hence the details have been omitted for purposes of simplicity and brevity.

A generally T-shaped, hand actuated switch lever 138 is pivotally supported relative to a generally matching T-shaped groove 140 in the outer surface of the main housing 13. The T-shaped lever 138 has a cross arm portion 139 extending transversely from a leg portion 141. The lever 138 is pivotally supported by a pair of pivot bolts 142 extending through clearance openings 144 through the cross arm portion 139 and into threaded openings 148 in the mating cross portion of groove 140. A conically shaped coil spring 150 is located with its enlarged end in a circular recess 152 in the T-shaped groove 140 and with its opposite, smaller end located in a radially aligned circular recess 154 in the bottom surface of the lever 138. In this way the leg portion 141 of the lever 138 is pivotally biased away from the confronting, matching surface of the groove 140. The free end of the leg portion 141 has a boss 158 on its lower surface with a magnet 160 supported in a recess in the boss 158. A Hall sensor 162 is supported on the circuit board 122 at a position substantially radially in line with the magnet 160. The Hall sensor 162 with associated circuitry on the circuit board 122 acts as an on-off switch in response to the pivotal actuation of the lever 138 moving the magnet 160 towards or away from the Hall sensor 162. Thus to energize the electric drive motor 18 the operator simply depresses the lever 138 until the boss 158 with the magnet 160 is located in a mating circular groove 163 placing the magnet 160 in a position to energize the Hall sensor 162 to actuate the circuitry on the circuit board 122 to energize the electric motor 18. Conversely, the motor 18 will be deenergized or turned off by the operator simply releasing the lever 138 which will then be biased to move the magnet 160 away from the Hall sensor 162.

The control circuit board 122 also has means to selectively energize the electric drive motor 18 to rotate either clockwise or counterclockwise. Thus a pair of semi-circular control plates 164 are adapted to be removably secured together for rotation in an annular groove 166 in the outer surface of the main housing 13 generally at the juncture of the control housing section 52 and support housing section 54. A separate spring loaded ball detent assembly 167 is operatively connected between each of the plates 164 and the groove 166 and provides a detented location of two different circumferential positions of the control plates 164 when they are secured together. Each of the control plates 164 is provided with a magnet 168. At the same time the circuit board 122 is provided with a pair of Hall sensors 170 adapted to be selectively aligned with the magnets 168 at the two different circumferential positions. A pair of open slots 172 are located in the control housing section 52 in line with the associated one of the Hall sensors 170 whereby the magnetic circuit between the magnets 168 on the control plates 164 will be open when the control plates 164 are rotated to the desired one of the detent positions. One of the Hall sensors 170 is connected to the circuitry of the circuit board 122 to actuate the circuitry to provide rotation of the electric motor 18 in one direction while the other Hall sensor 170 when actuated at the other detent position will actuate the circuitry to provide rotation in the opposite direction. Thus the torque tool assembly 10 can be selectively set by the operator to provide rotational torque for installing a threaded member or for removing the threaded member.

Figure 2:
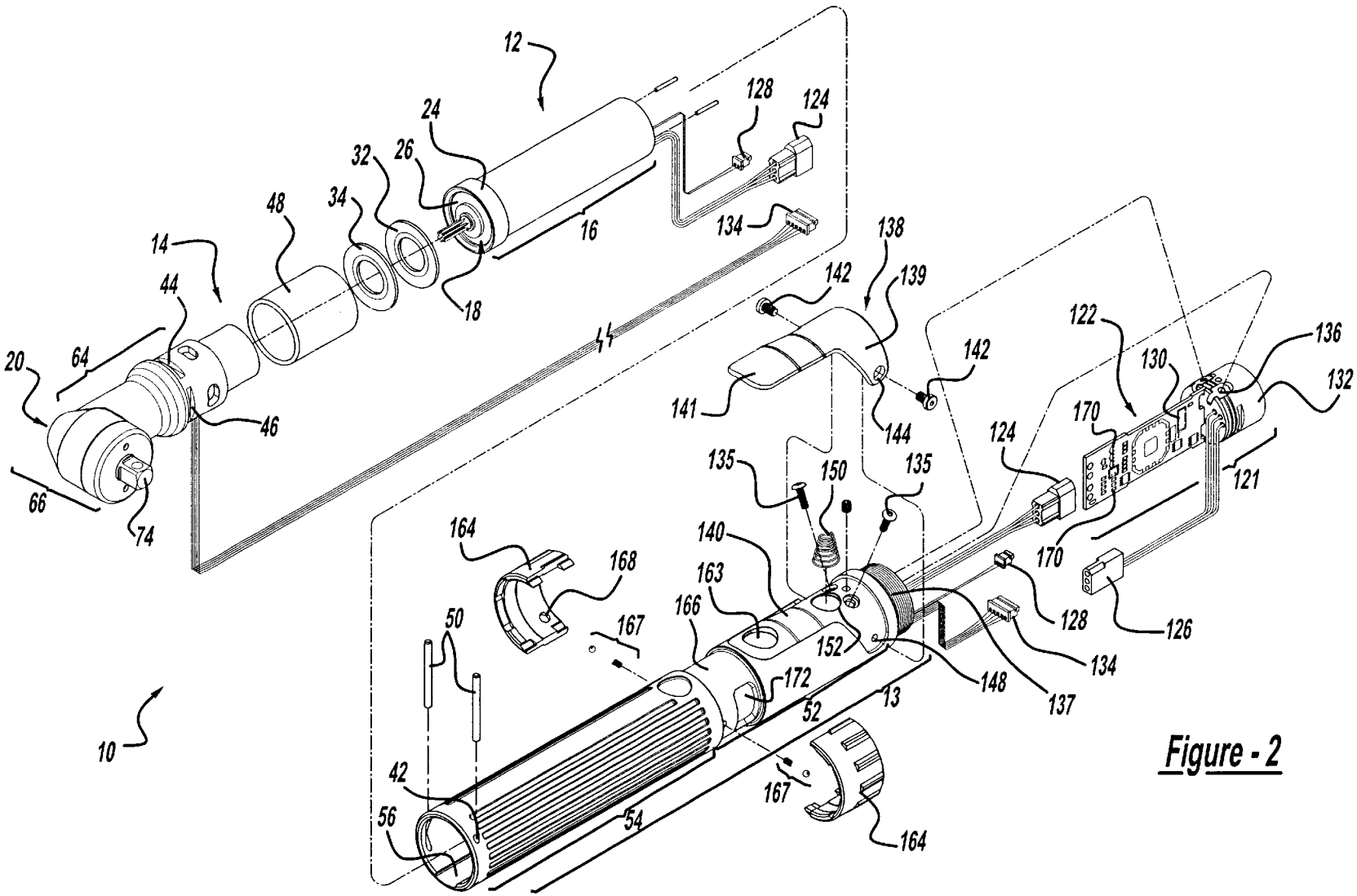
FIG. 2 is an exploded pictorial view of the torque tool assembly of FIG. 1 showing the various components of the torque tool assembly in a disassembled state and including the components omitted from FIG. 1.

As can be seen in FIGS. 1 and 2, the outer surface of the main housing 13, is provided with a plurality of longitudinally extending grooves to assist gripping by the operator. Other forms of surface contours could be used to facilitate gripping. It should also be understood that while the torque tool assembly is shown for applying torque by a right angled drive, it should be understood that the features of the present invention could be applied to a torque tool assembly adapted for axially in-line drive for torque application.

While it will be apparent that the preferred embodiments of the invention disclosed are well calculated to fulfill the objects stated above, it will be appreciated that the invention is susceptible to modification, variation and change without departing from the proper scope or fair meaning of the invention.

What is claimed is:

1. A torque tool assembly comprising:

a main housing being of a generally cylindrical elongated construction, a drive motor subassembly including a drive motor secured in a motor housing, a gear subassembly including a gear train structure supported in a gear train housing, drive means adapted to operatively engage said drive motor with said gear train structure whereby said drive motor can drive said gear train structure, said drive motor subassembly adapted to be mounted within said main housing while being freely moved from a forward end of said main housing, locating means operatively connected to said motor housing and said main housing for locating said drive motor subassembly at a pre-selected position within said main housing while blocking further movement of said drive motor subassembly into said main housing, said gear subassembly adapted to be mounted to said main housing with said gear train housing having a housing portion extending at least partially into said main housing with said drive means being operatively engaged, locking means operative with said main housing and said gear train housing and adapted to mechanically and immovably lock said gear train housing and thus said gear subassembly at a preselected position in said main housing, said preselected position of said gear subassembly placing said drive means into operative engagement between said drive motor and said gear train structure while locating said gear train housing a preselected distance from said motor housing to define a gap, resilient means located in said gap and in operative engagement with said motor housing and said gear train housing to bias said locating means to resiliently locate said drive motor subassembly at said preselected position within said main housing with said resilient bias being reacted through said gear train housing against said locking means, said gap maintaining the desired engagement and alignment of said drive means relative to said drive motor and said gear train structure.

2. The torque tool assembly of claim 1 with said locating means comprising a stop shoulder formed within said main housing at said preselected position, and a locating ring at the outer end of said motor housing with said locating ring adapted to engage said stop shoulder thereby blocking further axial movement of said drive motor into said main housing.

3. The torque tool assembly of claim 1 with said resilient means comprising at least one disc spring.

4. The torque tool assembly of claim 1 with said resilient means comprising a pair of operatively engaged disc springs.

5. The toque tool assembly of claim 1 with said gear assembly having a structure for providing a right angled drive along a drive axis in quadrature with the axis of said main housing, said locking means being selectively operable to permit the fixed location of said gear subassembly at different circumferential positions.

6. The torque tool assembly of claim 1 with said locking means comprising at least one locking pin adapted to be located in aligned openings in said main housing and said gear train housing, with said aligned openings and thus said locking pin when located therein extending transversely relative to the axis of said main housing.

7. The torque tool assembly of claim 1 with said locating means comprising a stop shoulder formed within said main housing at said preselected position, and a locating ring at the outer end of said motor housing with said locating ring adapted to engage said stop shoulder thereby blocking further axial movement of said drive motor into said main housing, said locking means comprising at least one locking pin adapted to be located in aligned openings in said main housing and said gear train housing, said aligned openings and thus said locking pin when located therein extending transversely relative to the axis of said main housing, said resilient means biasing said drive motor subassembly with said locating ring against said stop shoulder and said gear train housing against said locking means.

8. The torque tool assembly of claim 7 with said resilient means comprising at least one disc spring.

9. The torque tool assembly of claim 7 with said resilient means comprising a pair of operatively engaged disc springs.

10. The toque tool assembly of claim 7 with said gear assembly having a structure for providing a right angled drive along a drive axis in quadrature with the axis of said main housing, said locking means being selectively operable to permit the fixed location of said gear subassembly at different circumferential positions.

11. The torque tool assembly of claim 10 with said resilient means comprising at least one disc spring.

12. The torque tool assembly of claim 10 with said resilient means comprising a pair of operatively engaged disc springs.

13. The torque tool assembly of claim 7 with said gear train structure including a cylindrical ring gear, said cylindrical ring gear having one end fixed to said gear train housing and an opposite inner end extending axially rearwardly in said main housing, said resilient means comprising at least one disc spring operatively engaged between said opposite inner end of said ring gear and said outer end of said motor housing to resiliently bias said drive motor subassembly and said gear subassembly apart to fixed positions.

14. The torque tool assembly of claim 13 with said resilient means comprising a pair of operatively engaged disc springs.

15. The toque tool assembly of claim 13 with said gear assembly having a structure for providing a right angled drive along a drive axis in quadrature with the axis of said main housing, said locking means being selectively operable to permit the fixed location of said gear subassembly at different circumferential positions.

* * * * *